US007690588B2

(12) United States Patent
Gibson et al.

(10) Patent No.: US 7,690,588 B2
(45) Date of Patent: Apr. 6, 2010

(54) FUEL INJECTOR NOZZLE WITH FLOW RESTRICTING DEVICE

(75) Inventors: Dennis Henderson Gibson, Chillicothe, IL (US); Mark F. Sommars, Sparland, IL (US); Jin Hui Sun, Bloomington, IL (US); Hoisan Kim, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 295 days.

(21) Appl. No.: 11/882,245

(22) Filed: Jul. 31, 2007

(65) Prior Publication Data

US 2009/0032622 A1 Feb. 5, 2009

(51) Int. Cl.
*F02M 61/00* (2006.01)

(52) U.S. Cl. ..... 239/533.2; 239/533.12

(58) Field of Classification Search ..... 239/533.1, 239/533.2, 533.3, 533.5, 533.7, 533.11, 533.12
See application file for complete search history.

(56) References Cited

U.S. PATENT DOCUMENTS

| | | | | |
|---|---|---|---|---|
| 4,181,144 | A * | 1/1980 | Landen | 137/484.4 |
| 4,269,360 | A | 5/1981 | Kopse | |
| 4,897,907 | A * | 2/1990 | Kopiec et al. | 29/888.4 |
| 5,020,500 | A | 6/1991 | Kelly | |
| RE34,999 | E | 7/1995 | Kelly | |
| 5,647,536 | A | 7/1997 | Yen et al. | |
| 6,053,425 | A * | 4/2000 | Stringfellow | 239/124 |
| 6,053,432 | A * | 4/2000 | Stevens | 239/533.2 |
| 6,189,817 | B1 * | 2/2001 | Lambert | 239/533.2 |
| 6,216,964 | B1 * | 4/2001 | Lambert | 239/533.12 |
| 6,279,840 | B1 | 8/2001 | Buckley | |
| 6,499,467 | B1 | 12/2002 | Morris et al. | |
| 6,889,918 | B2 | 5/2005 | Harcombe | |
| 7,188,788 | B2 | 3/2007 | Augustin | |
| 7,334,741 | B2 * | 2/2008 | Benson et al. | 239/5 |
| 2002/0079386 | A1 | 6/2002 | Bonse et al. | |
| 2006/0243827 | A1 * | 11/2006 | Cooke | 239/533.12 |

FOREIGN PATENT DOCUMENTS

| | | |
|---|---|---|
| DE | 10149961 | 4/2003 |
| EP | 1035322 B1 | 5/2005 |
| WO | 02084109 | 10/2002 |

* cited by examiner

*Primary Examiner*—Thomas N Moulis
(74) *Attorney, Agent, or Firm*—Finnegan, Henderson, Farabow, Garrett & Dunner

(57) ABSTRACT

A fuel injector is provided having a needle valve element and a nozzle member with a central bore configured to slidingly receive the needle valve element. The fuel injector also has a spring configured to bias the needle valve element toward a closed position. In addition, the fuel injection assembly has a guide element configured to reduce a lateral movement of the needle valve element. The fuel injection assembly further has a fluid flow restricting device configured to restrict the flow of a fluid through the needle valve element and create a fluid pressure differential between the fluid upstream and downstream of the fluid flow restricting device.

20 Claims, 3 Drawing Sheets

FUEL INJECTOR NOZZLE WITH FLOW RESTRICTING DEVICE

TECHNICAL FIELD

The present disclosure is directed to a fuel injector and, more particularly, to a fuel injector having a flow restricting device.

BACKGROUND

Common rail fuel systems typically employ multiple fuel injectors to inject high pressure fuel into the combustion chambers of an engine. Each of these fuel injectors may include a nozzle assembly having a cylindrical bore with a nozzle supply passageway and a nozzle outlet. A needle check valve may be reciprocatingly disposed within the cylindrical bore and biased toward a closed position where the nozzle outlet is blocked. In response to a deliberate injection request, the needle check valve may be selectively moved to open the nozzle outlet, thereby allowing high pressure fuel to flow from the nozzle supply passageway into the combustion chamber.

For emissions reduction and increased engine performance, it is desired to decrease the volume of fuel delivered to a combustion chamber during an initial stage of a fuel injection event. One way to ensure accurate small volume delivery is to reduce the check seat diameter of the check valve. However, if the size of the check seat diameter is reduced, the check seat impact load needs to also be reduced to maintain injector integrity. Such a reduction may be accomplished by reducing the size of the biasing spring because the biasing spring is a significant contributor to the check seat impact load. It has been found, however, that reducing the size of the biasing spring requires a supplemental force to close the needle check valve.

An example of a fuel injector that includes a device providing a supplemental force for closing the needle check valve can be found in U.S. Pat. No. 7,188,788 (the '788 patent) issued to Augustin on Mar. 13, 2007. The '788 patent discloses a fuel injector having a needle check valve, which is biased toward a closed position by a biasing spring. A sleeve is disposed over a portion of the needle valve creating a metering landing, which effectively enlarges the diameter of the needle check valve at that location. The metering landing selectively overlaps a metering edge of a metering bore to define a fuel flow passage. During a fuel injection event, fuel is permitted to flow to the needle check valve creating enough pressure to counteract the force of the biasing spring. This allows the needle check valve to move to an open position. When the needle check valve moves toward the open position, the metering landing moves away from the metering edge, and the fuel flow passage is enlarged. The enlarged fuel flow passage allows fuel to flow freely from an upper surface of the metering landing to a lower surface of the metering landing and ultimately through an outlet of the fuel injector assembly. When it is desired to end fuel injection, fuel is prevented from flowing to the needle check valve, thereby decreasing the fuel pressure counteracting the force of the biasing spring. This allows the biasing spring to move the needle check valve toward a closed position and reduces the size of the fuel flow passage by moving the metering landing toward the metering edge. As the size of the fuel flow passage is reduced, the flow of fuel from the upper surface of the metering landing to the lower surface of the metering landing becomes restricted. This restricted flow produces a greater pressure above the upper surface of the metering landing than below the lower surface of the metering landing, thereby creating a force that assists the biasing spring to close the needle check valve.

Although the '788 patent discloses a fuel injector having a device that provides a supplemental force for closing the needle check valve, the fuel injector design may not adequately control the magnitude of the supplemental force. In particular, the size of the fuel flow passage varies during the closing and opening events. In addition, the design of the fuel injector may allow the needle check valve to move laterally, further varying the size of the fuel flow passage. The variable size of the fuel flow passage may produce unpredictable pressure differentials between the fuel above the upper surface of the metering landing and the fuel below the lower surface of the metering landing. Such unpredictable pressure differentials may ultimately lead to operational failures when closing the needle check valve due to excessive or insufficient supplemental forces.

The disclosed system is directed to overcoming one or more of the problems set forth above.

SUMMARY OF THE INVENTION

In one aspect, the disclosure is directed toward a fuel injector including a needle valve element and a nozzle member having a central bore configured to slidingly receive the needle valve element. The fuel injector also includes a spring configured to bias the needle valve element toward a closed position. In addition, the fuel injector includes a guide element configured to reduce a lateral movement of the needle valve element. The fuel injector further includes a fluid flow restricting device configured to restrict the flow of a fluid through the needle valve element and create a fluid pressure differential between the fluid upstream and downstream of the fluid flow restricting device.

Consistent with a further aspect of the disclosure, a method is provided for operating a fuel injector. The method includes directing a fluid through a central bore of a fuel injector needle valve element. The method also includes restricting the flow of the fluid through the central bore by directing the fluid through at least one annular channel having a fixed volume.

DETAILED DESCRIPTION

Figure 1:
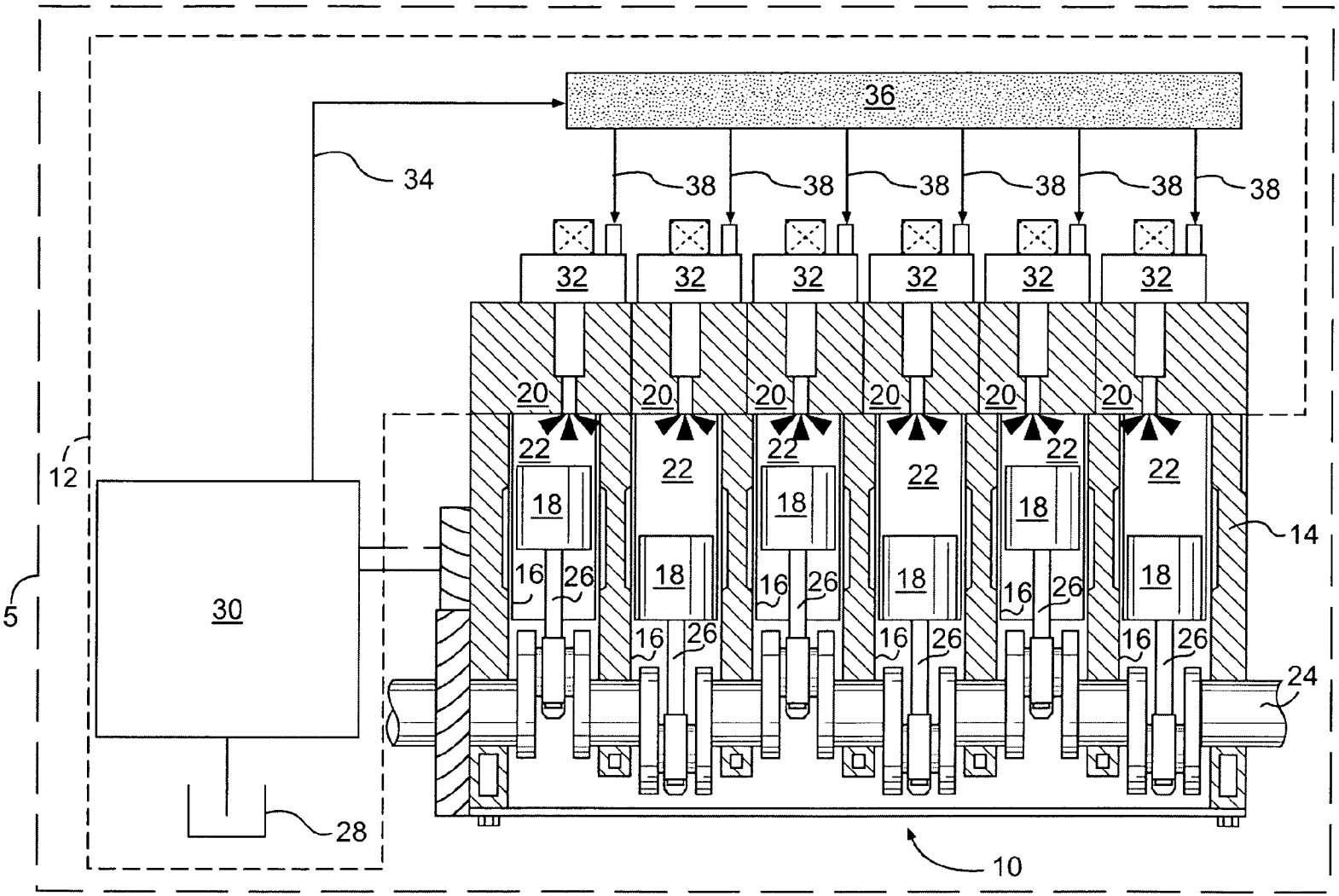
FIG. 1 is a schematic and diagrammatic illustration of an exemplary disclosed fuel system.

FIG. 1 illustrates a machine 5 having an engine 10 and an exemplary embodiment of a fuel system 12. Machine 5 may be a fixed or mobile machine that performs some type of operation associated with an industry such as mining, construction, farming, power generation, transportation, or any other industry known in the art. For example, machine 5 may embody an earth moving machine, a generator set, a pump, or any other suitable operation-performing machine.

For the purposes of this disclosure, engine 10 is depicted and described as a four-stroke diesel engine. One skilled in the art will recognize, however, that engine 10 may be any other type of internal combustion engine such as, for example, a gasoline or a gaseous fuel-powered engine. Engine 10 may include an engine block 14 that at least partially defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into each combustion chamber 22. Specifically, fuel system 12 may include a tank 28 configured to hold a supply of fuel, and a fuel pumping arrangement 30 configured to pressurize the fuel and direct the pressurized fuel to a plurality of fuel injectors 32 by way of a fuel line 34 and a common rail 36. It should be understood that fuel pumping arrangement 30 may include one or more pumping devices that function to increase the pressure of the fuel and direct one or more pressurized streams of fuel to common rail 36 via fuel line 34. Furthermore, it is contemplated that additional or different components may be included within fuel system 12, if desired, such as, for example, debris filters, water separators, makeup valves, relief valves, priority valves, and energy regeneration devices.

Figure 2:
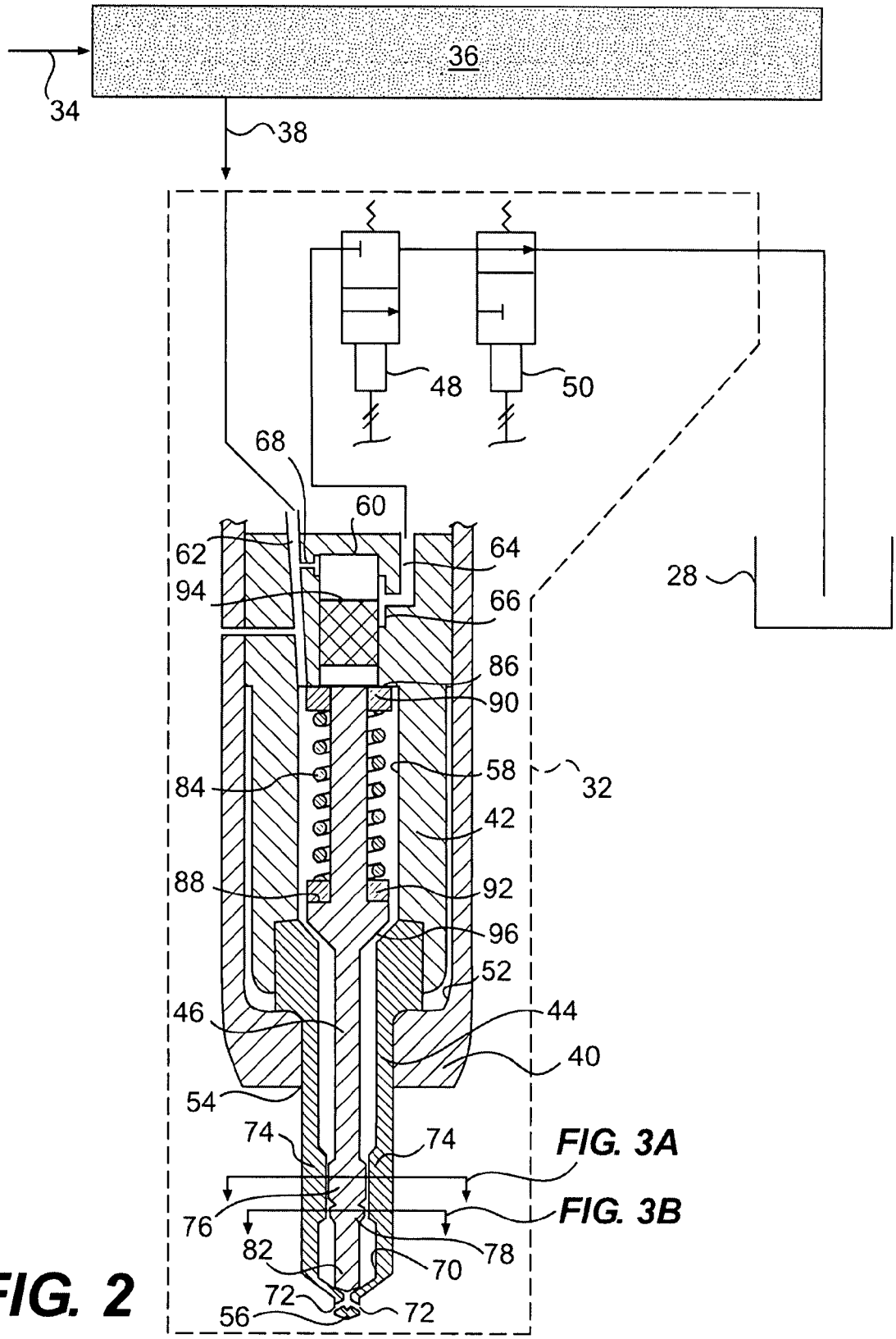
FIG. 2 is a cross-sectional illustration of an exemplary disclosed fuel injector for the fuel system of FIG. 1.

Fuel injectors 32 may be disposed within cylinder heads 20 and connected to common rail 36 by way of a plurality of fuel lines 38. Each fuel injector 32 may be operable to inject an amount of pressurized fuel into an associated combustion chamber 22 at predetermined timings, fuel pressures, and fuel flow rates. As illustrated in FIG. 2, each fuel injector 32 may embody a closed nozzle unit fuel injector. Specifically, each fuel injector 32 may include an injector body 40 housing a nozzle member guide 42, a nozzle member 44, a needle valve element 46, a first actuator 48, and a second actuator 50.

Injector body 40 may be a generally cylindrical member configured for assembly within cylinder head 20. Injector body 40 may have a central bore 52 for receiving nozzle member guide 42 and nozzle member 44, and an opening 54 through which a tip end 56 of nozzle member 44 may protrude. A sealing member such as, for example, an o-ring (not shown) may be disposed between nozzle member guide 42 and nozzle member 44 to restrict fuel leakage from fuel injector 32.

Nozzle member guide 42 may also be a generally cylindrical member having a central bore 58 configured to receive needle valve element 46, and a control chamber 60. Central bore 58 may act as a pressure chamber, holding pressurized fuel continuously supplied by way of a fuel supply passageway 62. During injection, the pressurized fuel from fuel line 38 may flow through fuel supply passageway 62 and central bore 58 to the tip end 56 of nozzle member 42.

Control chamber 60 may be selectively drained of or supplied with pressurized fuel to control motion of needle valve element 46. Specifically, a control passageway 64 may fluidly connect a port 66 associated with control chamber 60, and first actuator 48. Control chamber 60 may be continuously supplied with pressurized fuel via a restricted supply passageway 68 that is in communication with fuel supply passageway 62. The restriction of restricted supply passageway 68 may allow for a pressure drop within control chamber 60 when control passageway 66 is drained of pressurized fuel.

Nozzle member 44 may likewise embody a generally cylindrical member having a central bore 70 that is configured to receive needle valve element 46. Nozzle member 44 may further include one or more orifices 72 to allow injection of the pressurized fuel from central bore 70 into combustion chambers 22 of engine 10. In addition, nozzle member 44 may include a protrusion portion 74 having a greater thickness and a smaller inner diameter than the rest of nozzle member 44. It is contemplated that nozzle member 44 may be fabricated without protrusion portion 74, if desired.

Needle valve element 46 may be a generally elongated cylindrical member that is slidingly disposed within nozzle member guide 42 and nozzle member 44. In addition, needle valve element 46 may include a needle valve guide 76 and a flow restricting device 78 located adjacent to protrusion portion 74 of nozzle member 44. It should be understood that needle valve guide 76 and flow restricting device 78 may be integral to needle valve element 74. However, it is contemplated that needle valve guide 76 and flow restricting device 78 may be separate elements from needle valve element, if desired. In addition, although flow restricting device 78 is illustrated being positioned immediately downstream of needle valve guide 76, it is contemplated that flow restricting device may be positioned immediately upstream of needle valve guide 76, if desired.

Figure 3B:
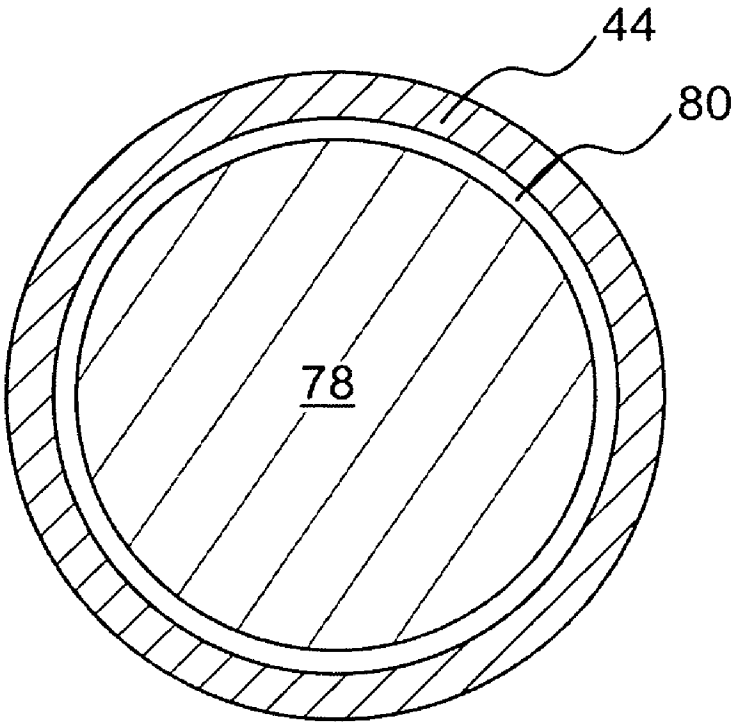
FIG. 3B is a cross-sectional illustration of an exemplary flow restricting device of the disclosed fuel injector of FIG. 2.
Figure 3A:
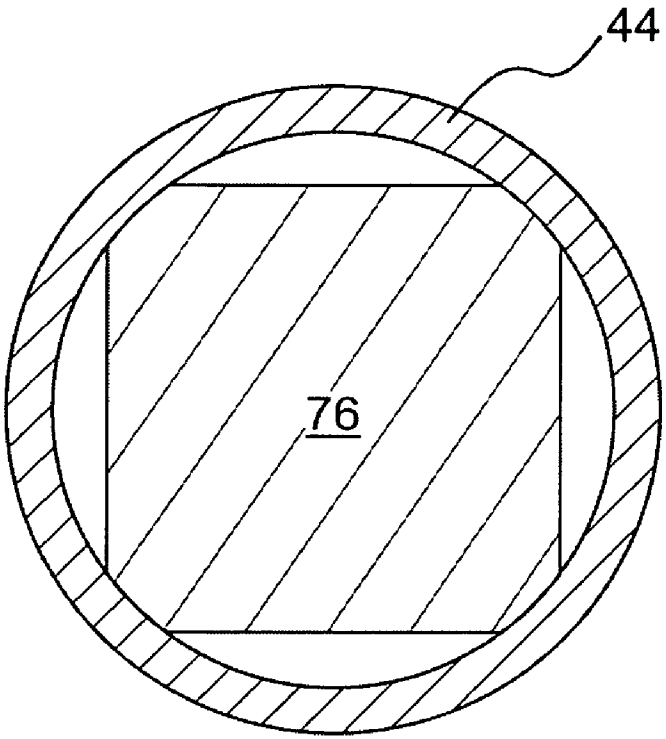
FIG. 3A is a cross-sectional illustration of an exemplary needle valve guide of the disclosed fuel injector of FIG. 2.

As illustrated in FIG. 3A, needle valve guide 76 may have a rectangular cross-sectional shape including four flat sides and four beveled corners matching the curvature of the inside surface of nozzle member 44. In addition, the beveled corners may be positioned against the inside surface of nozzle member 44 to reduce a lateral movement of needle valve element 46 within nozzle member 44. Reducing the lateral movement of needle valve element 46 may result in, for example, zero or relatively small lateral movement. It is contemplated that a lubricant or other friction reducing device may be positioned between the beveled corners of needle valve guide 76 and the inside surface of nozzle member 44 to reduce wear. It is further contemplated that needle valve guide 76 may be any shape capable of preventing needle valve 46 from moving laterally while permitting fuel to flow freely past needle valve guide 76.

As illustrated in FIG. 3B, flow restricting device 78 may have a circular cross-sectional shape creating an annular channel 80 through which fuel may flow between flow restricting device 78 and the inner surface of nozzle member 44. Flow restricting device 78 may be sized so that annular channel 80 may restrict the flow of fuel in central bore 70 and create a pressure differential between fuel upstream of flow restricting device 78 and fuel downstream of flow restricting device 78 during an end of injection event. The pressure differential may be within a predetermined range such as, for example, 2-6 Mpa. It is contemplated that, although flow restricting device 78 is illustrated having a circular cross-sectional shape, flow restricting device 78 may have any shape capable of restricting the flow of fuel within central bore 70.

Referring back to FIG. 2, needle valve element 46 may be axially movable between a first position at which a tip end 82 of needle valve element 46 blocks a flow of fuel through orifices 72, and a second position at which orifices 72 are open to allow a flow of pressurized fuel into combustion chamber 22. Needle valve element 46 may be normally biased toward the first position. In particular, each fuel injector 32 may include a spring 84 disposed between a stop 86 of nozzle member guide 42 and a seating surface 88 of needle valve element 46 to axially bias tip end 82 toward the orifice-blocking position. A first spacer 90 may be disposed between spring 84 and stop 86, and a second spacer 92 may be disposed between spring 84 and seating surface 88 to reduce wear of the components within fuel injector 32.

Needle valve element 46 may also include multiple driving hydraulic surfaces tending to drive needle valve element 46 to a first and a second position. In particular, needle valve element 46 may include a hydraulic surface 94 tending to drive needle valve element 46 toward the first or orifice-blocking position when acted upon by pressurized fuel, and a hydraulic surface 96 that tends to oppose the bias of spring 84 and drive needle valve element 46 in the opposite direction toward the second or orifice-opening position.

First actuator 48 and second actuator 50 may be disposed opposite tip end 82 of needle valve element 46 to control an opening and closing motion of needle valve element 46. In particular, first actuator 48 may include a two-position valve element disposed between control chamber 72 and tank 28 to control the opening motion of needle valve element 46. In addition, second actuator 50 may include a two-position valve element disposed between first actuator 48 and tank 28 to control the closing motion of needle valve element 46. It is contemplated that the valve elements of first and second actuators 48 and 50 may be electrically operated, hydraulically operated, mechanically operated, pneumatically operated, or operated in any other suitable manner.

INDUSTRIAL APPLICABILITY

The disclosed fuel injector may reduce emissions and increase engine performance by decreasing the volume of fuel delivered to a combustion chamber. In particular, the flow restricting device of the needle valve may provide a supplemental force capable of assisting the spring to move the needle valve element to a closed position. This may permit the size of the spring and the seating surface diameter to be reduced so that a smaller volume of fuel may be accurately delivered to the combustion chamber. The operation of fuel system 12 will now be explained.

Needle valve element 46 may be moved by an imbalance of force generated by fuel pressure. For example, when needle valve element 46 is in the first or orifice-blocking position, pressurized fuel from fuel supply passageway 62 may flow into control chamber 60 to act on hydraulic surface 94. Simultaneously, pressurized fuel from fuel supply passageway 62 may flow into central bores 58 and 70 in anticipation of injection. As fuel encounters annular channel 80 in central bore 70, the flow may be restricted. This restriction may produce a pressure differential between fuel upstream and downstream of flow restricting device 78, wherein fuel upstream of flow restricting device 78 may have a greater pressure than fuel downstream of flow restricting device 78. This pressure differential may generate a supplemental force pushing against flow restricting device 78 and acting to move needle valve element 46 toward a closed position. In addition, the pressure differential may be, for example, 2-6 Mpa.

The force of spring 84 combined with the hydraulic force generated at hydraulic surface 94 and the supplemental force generated by the pressure differential may be greater than an opposing force generated at hydraulic surface 96 thereby causing needle valve element 46 to remain in the first position to restrict fuel flow through orifices 72. To open orifices 72 and inject the pressurized fuel from central bore 70 into combustion chamber 22, first actuator 48 may move its associated valve element to selectively drain the pressurized fuel away from control chamber 60 and hydraulic surface 94. This decrease in pressure acting on hydraulic surface 94 may allow the opposing force acting across hydraulic surface 96 to overcome the biasing force of spring 84, thereby moving needle valve element 46 toward the orifice-opening position.

To close orifices 72 and end the injection of fuel into combustion chamber 22, second actuator 50 may be energized. In particular, as the valve element associated with second actuator 50 is urged toward the flow blocking position, fluid from control chamber 60 may be prevented from draining to tank 28. Because pressurized fluid is continuously supplied to control chamber 60 via restricted supply passageway 68, pressure may rapidly build within control chamber 60 when drainage through control passageway 64 is prevented. In addition, as disclosed above, a supplemental force may be generated by the pressure differential between fuel upstream and downstream of flow restricting device 78. The increasing pressure within control chamber 60, combined with the biasing force of spring 84 and supplemental force generated by the pressure differential, may overcome the opposing force acting on hydraulic surface 96 to force needle valve element 46 toward the closed position. It is contemplated that second actuator 50 may be omitted, if desired, and first solenoid actuator 48 used to initiate both the opening and closing motions of needle valve element 46.

By utilizing a needle valve guide in conjunction with a flow restricting device, the disclosed fuel injector may be able to accurately deliver a small volume of fuel. In particular, the flow restricting device may create an annular channel. The annular channel may create a pressure differential between fuel in an upper portion of a central bore and fuel in a lower portion of the central bore by restricting the fuel flow. Such a pressure differential may create a supplemental force for biasing the needle valve element to a closed position. The needle valve guide may maintain the size and shape of the annular channel by preventing the needle valve element from moving laterally. Furthermore, the distance between the flow restricting device and the inner surface of the central bore may remain the same during the closing and opening events. By maintaining the size and shape of the annular channel, the pressure differential between fuel upstream and downstream of the flow restricting device may be more accurately controlled. More accurate control over the pressure differential may minimize operational failures when closing the needle valve element due to excessive or insufficient supplemental forces.

It will be apparent to those skilled in the art that various modifications and variations can be made to the fuel system of the present disclosure without departing from the scope of the disclosure. Other embodiments will be apparent to those skilled in the art from consideration of the specification and practice of the fuel system disclosed herein. It is intended that the specification and examples be considered as exemplary only, with a true scope of the invention being indicated by the following claims and their equivalents.

What is claimed is:

1. A fuel injector, comprising:

a needle valve element;

a nozzle member having a central bore configured to slidingly receive the needle valve element, the nozzle member including a protrusion portion having a constant inner diameter;

a spring configured to bias the needle valve element toward a closed position;

a guide element configured to reduce a lateral movement of the needle valve element; and a fluid flow restricting device configured to restrict the flow of fluid through the needle valve element and create a fluid pressure differential between the fluid upstream and downstream of the fluid flow device, the guide element and the fluid flow restricting device adapted to slide only within the protrusion portion.

2. The fuel injector of claim 1, wherein the guide element is positioned adjacent to the fluid flow restricting device and between the spring and an outlet portion of the needle valve element.

3. The fuel injector of claim 2, wherein the guide element and the fluid flow restricting device are positioned to create at least one annular channel for directing fluid from an upper portion of the needle valve element to a lower portion of the needle valve element.

4. The fuel injector of claim 3, wherein the guide element and the fluid flow restricting device are integral to the needle valve element.

5. The fuel injector of claim 4, wherein the central bore includes a protruding portion at a location corresponding to the guide element and the fluid flow restricting device, the protruding portion having an inner diameter smaller than an inner diameter of the rest of the central bore.

6. The fuel injector of claim 5, wherein the guide element and the fluid flow restricting device have different shapes.

7. The fuel injector of claim 6, wherein the cross-sectional shape of the guide element has at least one flat side.

8. The fuel injector of claim 7, wherein the cross-sectional shape of the fluid flow restricting device is circular.

9. The fuel injector of claim 8, wherein the pressure differential created by the fluid flow device is within a range of approximately 2-6 Mpa.

10. A method for operating a fuel injector, comprising:

providing a fuel injector having a needle valve element, a nozzle member having a central bore configured to slidingly receive the needle valve element, a spring configured to bias the needle valve element toward a closed position, a guide element configured to reduce a lateral movement of the needle valve element, and a fluid flow restricting device configured to restrict the flow of fluid through the needle valve element and create a fluid pressure differential between the fluid upstream and downstream of the fluid flow device, the nozzle member further including a protrusion portion having a constant inner diameter, wherein the guide element and the fluid flow restricting device only slide within the protrusion portion;

directing a fluid through a central bore of a fuel injector needle valve element; and restricting the flow of fluid through the central bore by directing the fluid through at least one annular channel having a fixed volume.

11. The method of claim 10, wherein restricting the flow of fluid generates a pressure differential between fluid upstream and downstream of the annular channel.

12. The method of claim 11, wherein the pressure differential is within a range of approximately 2-6 Mpa.

13. A machine, comprising:

a power source having at least one combustion chamber;

at least one pumping element configured to pressurize a fuel; and a fuel injector configured to inject the pressurized fuel into the at least one combustion chamber, the fuel injector including:

a needle valve element;

a nozzle member having a central bore configured to slidingly receive the needle valve element, the nozzle member including a protrusion portion having a constant inner diameter;

a spring configured to bias the needle valve element toward a closed position;

a guide element configured to reduce a lateral movement of the needle valve element; and a fluid flow restricting device configured to restrict the flow of fluid through the needle valve element and create a fluid pressure differential between the fluid upstream and downstream of the fluid flow restricting device, the guide element and the fluid flow restricting device adapted to slide only within the protrusion portion.

14. The machine of claim 13, wherein the guide element is positioned adjacent to the fluid flow restricting device and between the spring and an outlet portion of the needle valve element.

15. The machine of claim 14, wherein the guide element and the fluid flow restricting device are positioned to create at least one annular channel for directing fluid from an upper portion of the needle valve element to a lower portion of the needle valve element.

16. The machine of claim 15, wherein the guide element and the fluid flow restricting device are integral to the needle valve element.

17. The machine of claim 16, wherein the central bore includes a protruding portion at a location corresponding to the guide element and the fluid flow restricting device, the protruding portion having an inner diameter smaller than an inner diameter of the rest of the central bore.

18. The machine of claim 17, wherein the guide element and the fluid flow restricting device have different shapes.

19. The machine of claim 18, wherein the cross-sectional shape of the guide element has at least one flat side.

20. The machine of claim 19, wherein the cross-sectional shape of the fluid flow restricting device is circular.

* * * * *